US011439180B2

(12) United States Patent
Liu et al.

(10) Patent No.: US 11,439,180 B2
(45) Date of Patent: Sep. 13, 2022

(54) ULTRASONIC ELECTRONIC CIGARETTE

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Hong Yu, Hunan (CN); Yuangang Dai, Hunan (CN); Xinqiang Yin, Hunan (CN); Jianhua Yi, Hunan (CN); Yongquan Zhou, Hunan (CN); Yang Wang, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 276 days.

(21) Appl. No.: 16/769,543

(22) PCT Filed: Dec. 7, 2018

(86) PCT No.: PCT/CN2018/119798
§ 371 (c)(1),
(2) Date: Jun. 3, 2020

(87) PCT Pub. No.: WO2019/110007
PCT Pub. Date: Jun. 13, 2019

(65) Prior Publication Data

US 2021/0212362 A1 Jul. 15, 2021

(30) Foreign Application Priority Data

Dec. 7, 2017 (CN) ..... 201721685711.2

(51) Int. Cl.
*A24F 40/05* (2020.01)
*A24F 40/10* (2020.01)
(Continued)

(52) U.S. Cl.
CPC ..... *A24F 40/05* (2020.01); *A24F 40/42* (2020.01); *A24F 40/44* (2020.01); *B05B 17/0607* (2013.01); *A24F 40/10* (2020.01)

(58) Field of Classification Search
CPC ..... A24F 40/05; A24F 40/42; A24F 40/44; A24F 40/10; B05B 17/0607
See application file for complete search history.

(56) References Cited

U.S. PATENT DOCUMENTS

2020/0221776 A1* 7/2020 Liu ..... A24F 7/00
2020/0253279 A1* 8/2020 Liu ..... A24F 40/40
(Continued)

FOREIGN PATENT DOCUMENTS

CN 204146335 U 2/2015
CN 205757206 U 12/2016
(Continued)

OTHER PUBLICATIONS

International Search Report issued in International Application No. PCT/CN2018/119798 dated Mar. 11, 2019, 3 pages.

*Primary Examiner* — Frederick C Nicolas
(74) *Attorney, Agent, or Firm* — Mauriel Kapouytian Woods LLP; Liang Huang; Michael Mauriel

(57) ABSTRACT

An ultrasonic electronic cigarette is disclosed. The electronic cigarette includes an atomizer (1) and a battery assembly (2) detachably connected to each other. The atomizer (1) comprises an ultrasonic atomization sheet (3), and the battery assembly (2) comprises a first battery electrode (4) and a second battery electrode (5) for supplying power to the atomizer (1). When the atomizer (1) is connected to the battery assembly (2), a first pole of the ultrasonic atomization sheet (3) is electrically connected to the first
(Continued)

battery electrode (4), and a second pole of the ultrasonic atomization sheet (3) is electrically connected to the second battery electrode (5).

20 Claims, 5 Drawing Sheets

(51) Int. Cl.

| | |
|---|---|
| ***A24F 40/42*** | (2020.01) |
| ***B05B 17/06*** | (2006.01) |
| ***A24F 40/44*** | (2020.01) |

(56) References Cited

U.S. PATENT DOCUMENTS

| | | | | |
|---|---|---|---|---|
| 2021/0076733 | A1* | 3/2021 | Liu | B05B 17/0684 |
| 2021/0112858 | A1* | 4/2021 | Liu | A24F 40/05 |
| 2021/0345664 | A1* | 11/2021 | Liu | A24F 40/70 |
| 2021/0378303 | A1* | 12/2021 | Liu | A24F 40/46 |

FOREIGN PATENT DOCUMENTS

| | | | |
|---|---|---|---|
| CN | 205947126 | U | 2/2017 |
| CN | 206303211 | U | 7/2017 |
| CN | 207613202 | U | 7/2018 |
| JP | 2001069963 | A | 3/2001 |

* cited by examiner

ULTRASONIC ELECTRONIC CIGARETTE

CROSS REFERENCE TO RELATED APPLICATIONS

This application is a U.S. National Phase application under 35 U.S.C. § 371 of International Application No. PCT/CN2018/119798 filed on Dec. 7, 2018, which claims priority to Chinese Application Number 201721685711.2 filed on Dec. 7, 2017. The entire contents of these applications are hereby incorporated herein by reference.

FIELD OF THE INVENTION

The present invention belongs to the technical field of electronic cigarettes, and particularly relates to an ultrasonic electronic cigarette.

BACKGROUND OF THE INVENTION

An ultrasonic electronic cigarette includes an atomizer and a battery assembly detachably connected to each other, wherein the atomizer includes an ultrasonic atomization sheet, and the battery assembly includes a first battery electrode and a second battery electrode for supplying power to the atomizer. When the electronic cigarette is used by a user, the atomizer is connected to the battery assembly. At this moment, a first pole of the ultrasonic atomization sheet is connected to the first battery electrode, and a second pole of the ultrasonic atomization sheet is connected to the second battery electrode, thus forming a circuit for supplying power to the ultrasonic atomization sheet.

The ultrasonic atomization sheet is equivalent to a capacitor, so the ultrasonic atomization sheet stores high energy after the atomizer is used and pulled out. When the user touches the atomizer, his fingers may accidentally in contact with the two poles of the ultrasonic atomization sheet to form a conducted circuit, causing a discharge of the ultrasonic atomization sheet, and the user feels shocked and is easily frightened, so the user experience is poor. At the same time, when the atomizer and the battery assembly are connected next time, the energy stored on the ultrasonic atomization sheet will be released through a main board of the electronic cigarette at the moment of connection, and the excessive voltage or current of momentary discharge will burn out some components on the main board, so that the electronic cigarette has a short service life, a high usage cost and a poor user experience.

SUMMARY OF THE INVENTION

The present invention aims to provide an improved electronic cigarette against the above shortcomings of the prior art, where after an atomizer is pulled out of a battery assembly, two poles of an ultrasonic atomization sheet are short-circuited inside the atomizer to release energy; when the atomizer is connected to the battery assembly, the two poles of the ultrasonic atomization sheet are disconnected inside the atomizer, which will not affect the normal operation of the ultrasonic atomization sheet, and will not discharge due to unintended touch or at the moment when the atomizer and the battery assembly are connected, thereby preventing electronic components from being burnt out due to excessive voltage caused by the momentary discharge of the ultrasonic atomization sheet, achieving a high safety coefficient, a long service life and a low usage cost, and having a good user experience.

In order to solve the above technical problems, the technical solution adopted by the present invention is as follows:

An ultrasonic electronic cigarette is provided, including an atomizer and a battery assembly detachably connected to each other, wherein the atomizer includes an ultrasonic atomization sheet, and the battery assembly includes a first battery electrode and a second battery electrode for supplying power to the atomizer; when the atomizer is connected to the battery assembly, a first pole of the ultrasonic atomization sheet is electrically connected to the first battery electrode, and a second pole of the ultrasonic atomization sheet is electrically connected to the second battery electrode; and the atomizer also includes a conductive sheet capable of being electrically connected to the two poles of the ultrasonic atomization sheet respectively when the atomizer is disconnected from the battery assembly, and being electrically disconnected from either pole of the ultrasonic atomization sheet when the atomizer is connected to the battery assembly.

With the above structure, when the atomizer is disconnected from the battery assembly, the conductive sheet inside the atomizer connects the two poles of the ultrasonic atomization sheet to short-circuit the ultrasonic atomization sheet itself, and the ultrasonic atomization sheet itself releases energy, thereby preventing the two poles of the ultrasonic atomization sheet from forming a conductive circuit by human conduction when the human body touches the two poles of the atomizer by mistake to cause the ultrasonic atomization sheet to discharge such that the human body feels an electric shock. At the same time, when the atomizer is disconnected from the battery assembly, the ultrasonic atomization sheet discharges by short-circuiting itself, which reduces the energy carried by the ultrasonic atomization sheet. Therefore, when the atomizer and the battery assembly are connected again, the ultrasonic atomization sheet will not momentarily release a high voltage to impact electronic components of the battery assembly, that is to say, the ultrasonic atomization sheet can be prevented from momentarily releasing a high voltage or current to burn out the electronic components, so that the ultrasonic electronic cigarette has a higher safety coefficient, a long service life and a low usage cost in use. When the atomizer is connected to the battery assembly, the conductive sheet is disconnected from either pole of the ultrasonic atomization sheet, and the atomizer and the battery assembly form a conductive circuit, so that the ultrasonic atomization sheet is in normal use (that is, the ultrasonic electronic cigarette can be used normally).

Further, the atomizer includes an elastic connecting mechanism, and the battery assembly includes a support corresponding to the elastic connecting mechanism; when the atomizer is connected to the battery assembly, one end of the elastic connecting mechanism abuts against the support, and the other end of the elastic connecting mechanism abuts against the conductive sheet such that the conductive sheet is electrically disconnected from either pole of the ultrasonic atomization sheet; and when the atomizer is disconnected from the battery assembly, the elastic connecting mechanism is reset and the conductive sheet is electrically connected to the two poles of the ultrasonic atomization sheet respectively.

The elastic connecting mechanism is disposed in the atomizer to drive the conductive sheet to move. When the atomizer is not electrically connected to the battery assembly, the two poles of the ultrasonic atomization sheet inside the atomizer are connected by the conductive sheet to form a closed loop, and the ultrasonic atomization sheet itself is short-circuited, thereby releasing all the energy on the ultrasonic atomization sheet, preventing the ultrasonic atomization sheet from momentarily releasing high energy after the atomizer is connected to the circuit of the battery assembly again to burn out a main board on the battery assembly, prolonging the service life of the main board of the electronic cigarette, reducing the use cost, preventing the user from feeling an electric shock when touching the two poles of the atomizer by mistake, and improving the user experience of safety and reliability.

As a preferred mode, the atomizer includes a lower electrode and a threaded seat, the first pole of the ultrasonic atomization sheet is electrically connected to the lower electrode, and the second pole of the ultrasonic atomization sheet is electrically connected to the threaded seat; when the atomizer is connected to the battery assembly, one end of the elastic connecting mechanism abuts against the conductive sheet such that the conductive sheet is electrically disconnected from the threaded seat; and when the atomizer is disconnected from the battery assembly, the elastic connecting mechanism is reset and both the lower electrode and the threaded seat are electrically connected to the conductive sheet.

As a preferred mode, the lower electrode is insulated from and connected to the threaded seat through an insulating ring; the elastic connecting mechanism includes an ejection shaft and a first spring, the insulating ring is provided with a through hole, the ejection shaft is disposed in the through hole and can move along the through hole, the ejection shaft is higher than the through hole, the first spring is sleeved on a middle section of the ejection shaft, one end of the first spring abuts against an outer side wall of the ejection shaft, and the other end of the first spring abuts against an inner side wall of the through hole; when the atomizer is connected to the battery assembly, the first spring is compressed, a bottom end of the ejection shaft abuts against the support, and a top end of the ejection shaft abuts against the conductive sheet such that the conductive sheet is disconnected from the threaded seat; and when the atomizer is disconnected from the battery assembly, the ejection shaft moves down under the restoring force of the first spring, and the conductive sheet is reset and abuts against the threaded seat.

As a preferred mode, one end of the conductive sheet is fixedly connected to the lower electrode, the bottom surface of a middle section of the conductive sheet abuts against the top end of the ejection shaft, and the bottom surface of the other end of the conductive sheet moves up and down with the ejection shaft to be connected with or disconnected from the threaded seat.

With the above structure, when the atomizer is not connected to the battery assembly, the ejection shaft protrudes from the bottom of the atomizer under the action of the first spring, so that the conductive sheet connects the positive and negative poles of the atomizer, that is, the ultrasonic atomization sheet, the lower electrode, the conductive sheet, the threaded seat, and the ultrasonic atomization sheet form a closed loop. The energy of the ultrasonic atomization sheet is released in a form of short-circuiting, thereby preventing the ultrasonic atomization sheet from momentarily releasing the energy carried by itself to the main board of the electronic cigarette to burn out the board after the atomizer is inserted into the battery assembly.

As another preferred mode, the conductive sheet is fixedly connected to the top of the ejection shaft and can move up and down with the ejection shaft; when the atomizer is connected to the battery assembly, the first spring is compressed, the ejection shaft drives the conductive sheet to move up, and the threaded seat and the lower electrode are both disconnected from the conductive sheet; and when the atomizer is disconnected from the battery assembly, the ejection shaft moves down under the restoring force of the first spring, and the conductive sheet is reset and abuts against the lower electrode and the threaded seat.

The conductive sheet is firmly connected to the top of the ejection shaft; when the atomizer is connected to the battery assembly, the ejection shaft is lifted by the support, and the conductive sheet moves up with the ejection shaft without contacting the threaded seat and the lower electrode, so when the atomizer is connected to the battery assembly, a short circuit does not occur inside the atomizer; and at this time, the circuit in the battery assembly is conducted again, and the atomizer can operate normally. The atomizer is easy to assemble and convenient to operate.

Further, the insulating ring is also provided with a limiting boss for preventing the ejection shaft from falling off from the through hole.

As a preferred mode, one end of the conductive sheet is fixedly connected to the lower electrode by riveting.

One end of the conductive sheet is fixed to the lower electrode by riveting, and the other end of the conductive sheet movably abuts against the threaded seat, so the assembly is simple.

Further, the atomizer includes a liquid chamber, and a liquid guiding mechanism for connecting the liquid chamber and the ultrasonic atomization sheet.

As a preferred mode, the atomizer includes a cup-shaped atomization cotton, a liquid storage cotton tube, an inner sleeve and an outer sleeve sleeved on the inner sleeve, a side wall of the atomization cotton is sleeved between the inner sleeve and the outer sleeve, an outer bottom surface of the atomization cotton abuts against the atomization cotton of the ultrasonic atomization sheet, the liquid storage cotton tube is sleeved between the atomization cotton and the inner sleeve, and the outer sleeve is provided with a liquid inlet hole for connecting the liquid chamber with the atomization cotton. Compared with the prior art, the present invention has the advantages that after the atomizer is pulled out of the battery assembly, the two poles of the ultrasonic atomization sheet are short-circuited inside the atomizer to release energy; when the atomizer is connected to the battery assembly, the two poles of the ultrasonic atomization sheet are disconnected inside the atomizer without affecting the normal operation of the ultrasonic atomization sheet (that is to say, after the atomizer is connected to the battery assembly, the electronic cigarette can be used normally), so the human body will not feel an electronic shock after the atomizer is disconnected from the battery assembly, electronic components will not be burnt out by excessive voltage or current released at the moment of connection between the atomizer and the battery assembly, and the electronic cigarette achieves a higher safety coefficient in use, and has a long service life, a low usage cost and a good user experience.

In which: 1 atomizer, 2 battery assembly, 3 ultrasonic atomization sheet, 4 first battery electrode, 5 second battery electrode, 6 elastic connecting mechanism, 7 support, 8 lower electrode, 9 threaded seat, 10 insulating ring, 101 through hole, 102 limiting boss, 11 ejection shaft, 12 first spring, 13 liquid chamber, 14 atomization cotton, 15 liquid storage cotton tube, 16 inner sleeve, 17 outer sleeve, 1701 liquid inlet hole, 18 suction nozzle, 19 gasket, 20 adapter, 21 upper cover, 22 connecting sleeve, 23 air inlet tube, 24 second spring, 25 seal ring, 26 lower cover, 27 bottom cover, 28 atomization seat, 29 conductive sheet.

DETAILED DESCRIPTION OF EMBODIMENTS

Embodiment 1

Figure 1:
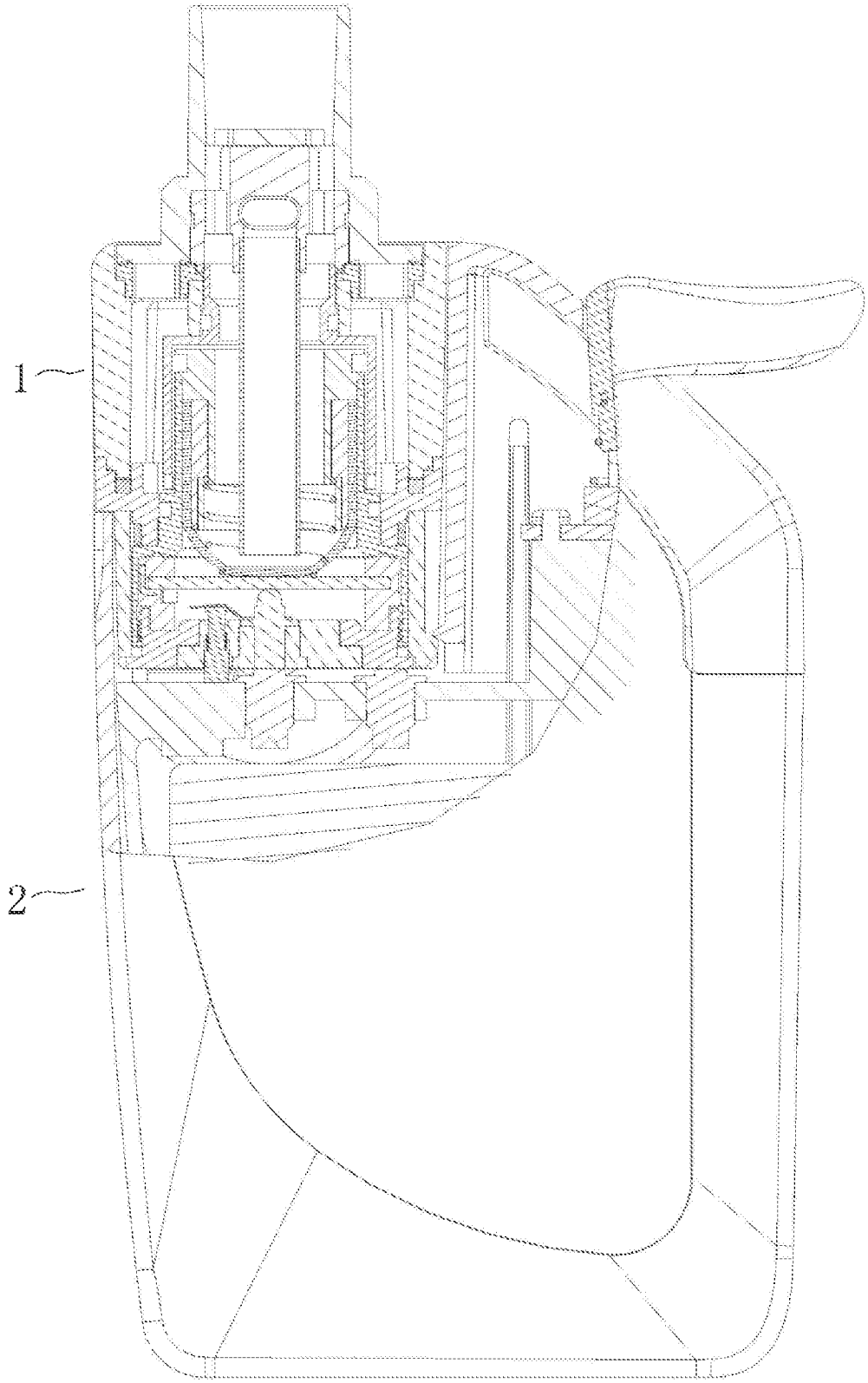
FIG. 1 is a schematic structural diagram of Embodiment 1 of an ultrasonic electronic cigarette.
Figure 2:
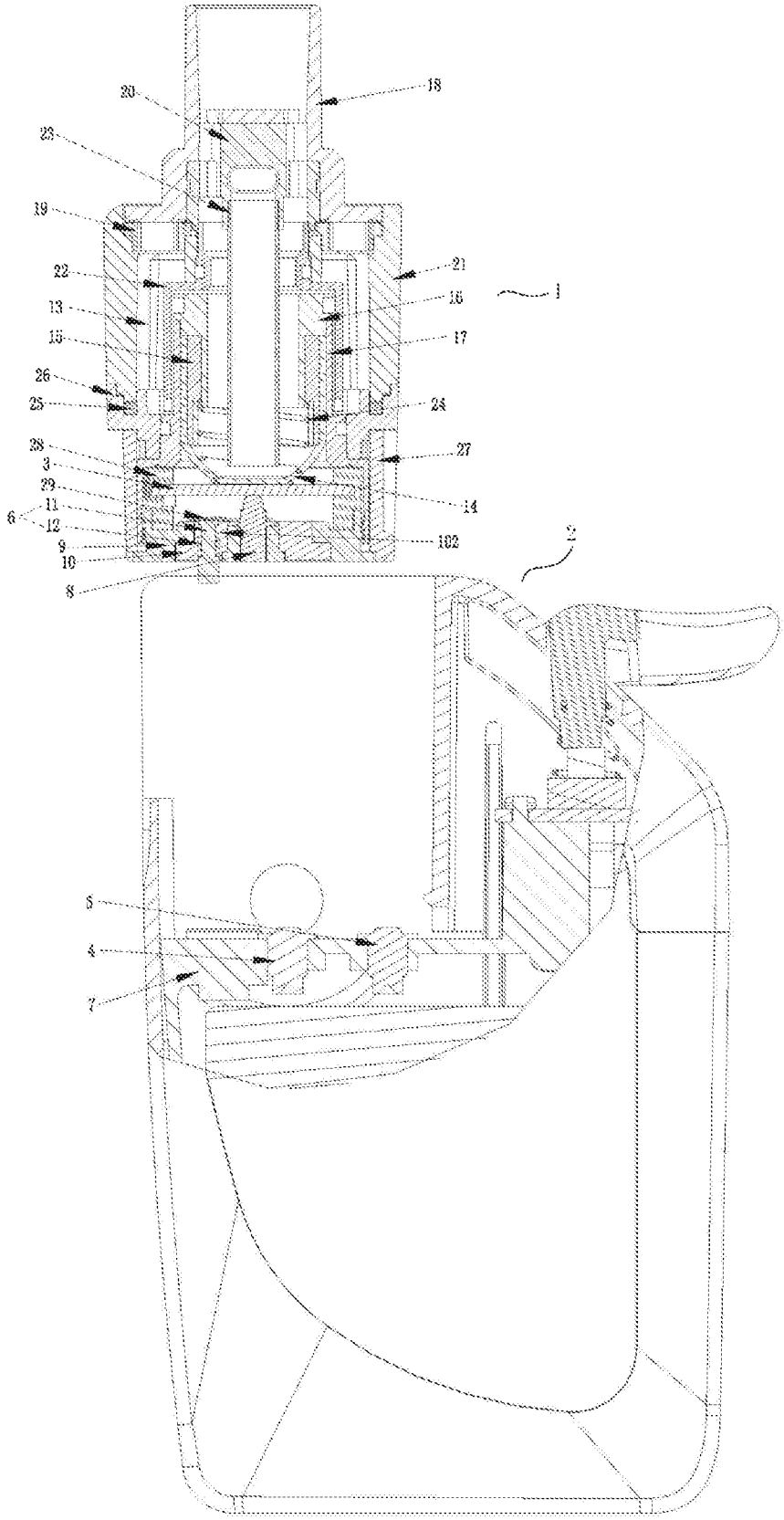
FIG. 2 is a schematic structural diagram when an atomizer and a battery assembly in FIG. 1 are separated.
Figure 3:
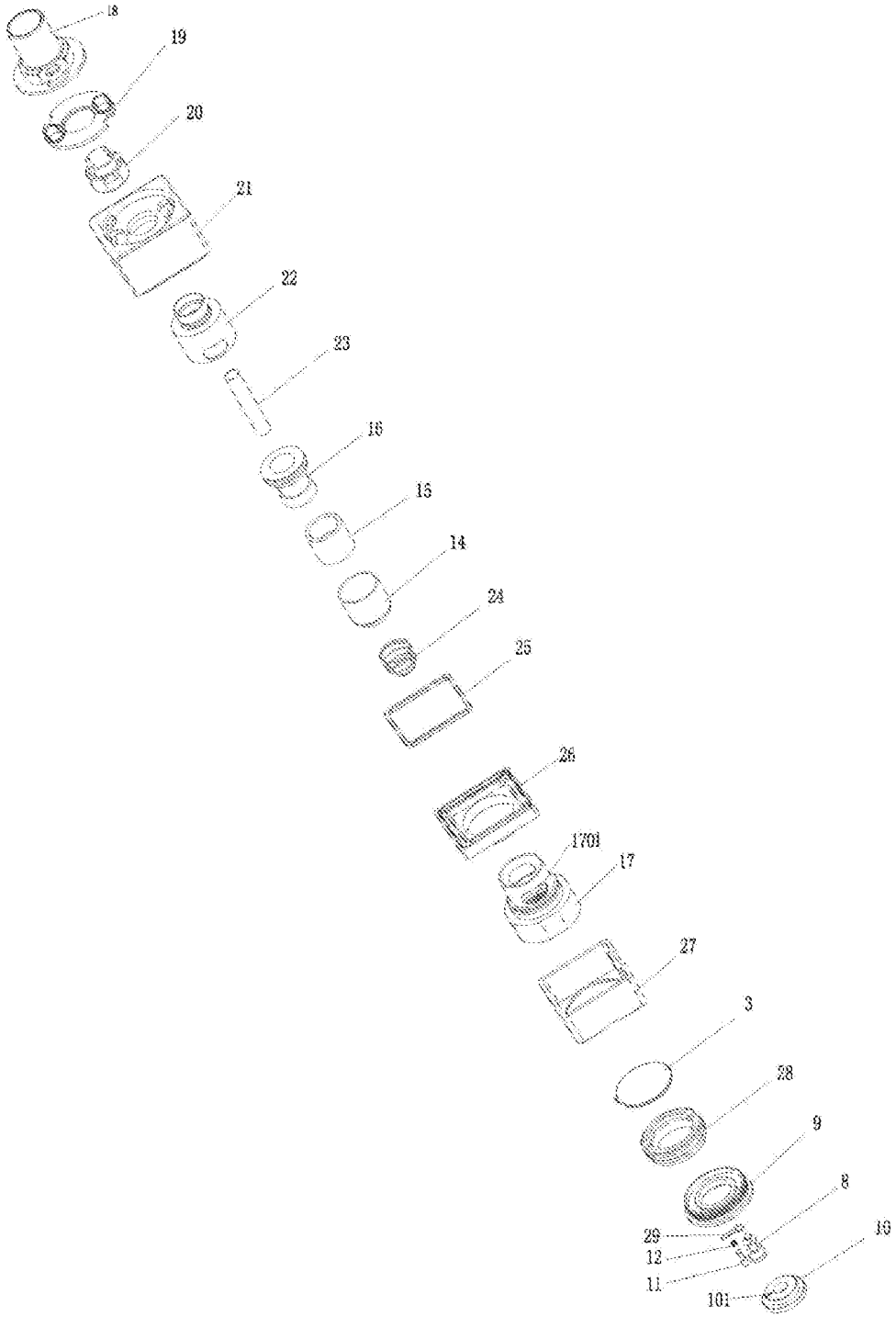
FIG. 3 is an exploded view of the atomizer in FIG. 1.

As shown in FIG. 1 to FIG. 3, the ultrasonic electronic cigarette includes an atomizer 1 and a battery assembly 2 detachably connected to each other, wherein the atomizer 1 includes an ultrasonic atomization sheet 3, and the battery assembly 2 includes a first battery electrode 4 and a second battery electrode 5 for supplying power to the atomizer 1; when the atomizer 1 is connected to the battery assembly 2, a first pole of the ultrasonic atomization sheet 3 is electrically connected to the first battery electrode 4, and a second pole of the ultrasonic atomization sheet 3 is electrically connected to the second battery electrode 5; and the atomizer 1 also includes a conductive sheet 29 capable of being electrically connected to the two poles of the ultrasonic atomization sheet 3 respectively when the atomizer 1 is disconnected from the battery assembly 2, and being electrically disconnected from either pole of the ultrasonic atomization sheet 3 when the atomizer 1 is connected to the battery assembly 2. The conductive sheet 29 has certain elasticity and also has conductivity, and the ultrasonic atomization sheet 3 is a piezoelectric ceramic atomization sheet.

The atomizer 1 includes an elastic connecting mechanism 6, and the battery assembly 2 includes a support 7 corresponding to the elastic connecting mechanism 6; when the atomizer 1 is connected to the battery assembly 2, one end of the elastic connecting mechanism abuts against the support 7, and the other end of the elastic connecting mechanism 6 abuts against the conductive sheet 29 such that the conductive sheet 29 is electrically disconnected from either pole of the ultrasonic atomization sheet 3; and when the atomizer 1 is disconnected from the battery assembly 2, the elastic connecting mechanism 6 is reset and the conductive sheet 29 is electrically connected to the two poles of the ultrasonic atomization sheet 3 respectively.

The atomizer 1 includes a lower electrode 8 and a threaded seat 9, the first pole of the ultrasonic atomization sheet 3 is electrically connected to the lower electrode 8, and the second pole of the ultrasonic atomization sheet 3 is electrically connected to the threaded seat 9; when the atomizer 1 is connected to the battery assembly 2, one end of the elastic connecting mechanism 6 abuts against the conductive sheet 29 such that the conductive sheet 29 is electrically disconnected from the threaded seat 9; and when the atomizer 1 is disconnected from the battery assembly 2, the elastic connecting mechanism 6 is reset and both the lower electrode 8 and the threaded seat 9 are electrically connected to the conductive sheet 29.

The lower electrode 8 is insulated from and connected to the threaded seat 9 through an insulating ring 10; the elastic connecting mechanism 6 includes an ejection shaft 11 and a first spring 12, the insulating ring 10 is provided with a through hole 101, the ejection shaft 11 is disposed in the through hole 101 and can move along the through hole 101, the ejection shaft 11 is higher than the through hole 101, the first spring 12 is sleeved on a middle section of the ejection shaft 11, one end of the first spring 12 abuts against an outer side wall of the ejection shaft 11, and the other end of the first spring 12 abuts against an inner side wall of the through hole 101; when the atomizer 1 is connected to the battery assembly 2, the first spring 12 is compressed, a bottom end of the ejection shaft 11 abuts against the support 7, and a top end of the ejection shaft 11 abuts against the conductive sheet 29 such that the conductive sheet 29 is disconnected from the threaded seat 9; and when the atomizer 1 is disconnected from the battery assembly 2, the ejection shaft 11 moves down under the restoring force of the first spring 12, and the conductive sheet 29 is reset and abuts against the threaded seat 9.

One end of the conductive sheet 29 is fixedly connected to the lower electrode 8, the bottom surface of a middle section of the conductive sheet 29 abuts against the top end of the ejection shaft 11, and the bottom surface of the other end of the conductive sheet 29 moves up and down with the ejection shaft 11 to be connected with or disconnected from the threaded seat 9.

The insulating ring 10 is also provided with a limiting boss 102 for preventing the ejection shaft 11 from falling off from the through hole 101.

One end of the conductive sheet 29 is fixedly connected to the lower electrode 8 by riveting.

The atomizer 1 includes a liquid chamber 13, and a liquid guiding mechanism for connecting the liquid chamber 13 and the ultrasonic atomization sheet 3.

The atomizer 1 includes a cup-shaped atomization cotton 14, a liquid storage cotton tube 15, an inner sleeve 16 and an outer sleeve 17 sleeved on the inner sleeve 16, a side wall of the atomization cotton 14 is sleeved between the inner sleeve 16 and the outer sleeve 17, an outer bottom surface of the atomization cotton 14 abuts against the atomization cotton 14 of the ultrasonic atomization sheet 3, the liquid storage cotton tube 15 is sleeved between the atomization cotton 14 and the inner sleeve 16, and the outer sleeve 17 is provided with a liquid inlet hole 1701 for connecting the liquid chamber 13 with the atomization cotton 14.

The atomizer 1 also includes a suction nozzle 18, a gasket 19, an adapter 20, an upper cover 21, a connecting sleeve 22, an air inlet tube 23, a second spring 24, a seal ring 25, a lower cover 26, a bottom cover 27, and an atomization seat 28. The suction nozzle 18 is connected to a top end of the upper cover 21, and a bottom end of the upper cover 21 is connected to the bottom cover 27 through the lower cover 26. The adapter 20 is fixed in the suction nozzle 18, one end of the air inlet tube 23 is fixedly connected to the adapter 20 and communicated with the outside, and the other end of the air inlet tube 23 is communicated with an inner bottom surface of the atomization cotton 14. The inner bottom surface of the atomization cotton 14 is communicated with the suction nozzle 18 through a gap between the inner sleeve 16 and the air inlet tube 23. The gasket 19 is disposed between the upper cover 21 and the suction nozzle 18. The connecting sleeve 22 connected to the adapter 20 is disposed in the upper cover 21, and the outer sleeve 17 is fixed in the connecting sleeve 22. The gasket 19 is disposed between the lower cover 26 and the upper cover 21. The atomization seat 28 for fixing the ultrasonic atomization sheet 3 is disposed at the bottom of the outer sleeve 17. The threaded seat 9 is screwed with the bottom of the outer sleeve 17. One pole of the ultrasonic atomization sheet 3 is electrically connected to the threaded seat 9 through the outer sleeve 17, and the other pole of the ultrasonic atomization sheet 3 is electrically connected to the lower electrode 8. One end of the second spring 24 abuts against the inner sleeve 16, and the other end of the second spring 24 abuts against the inner bottom surface of the atomization cotton 14.

Embodiment 2

Figure 4:
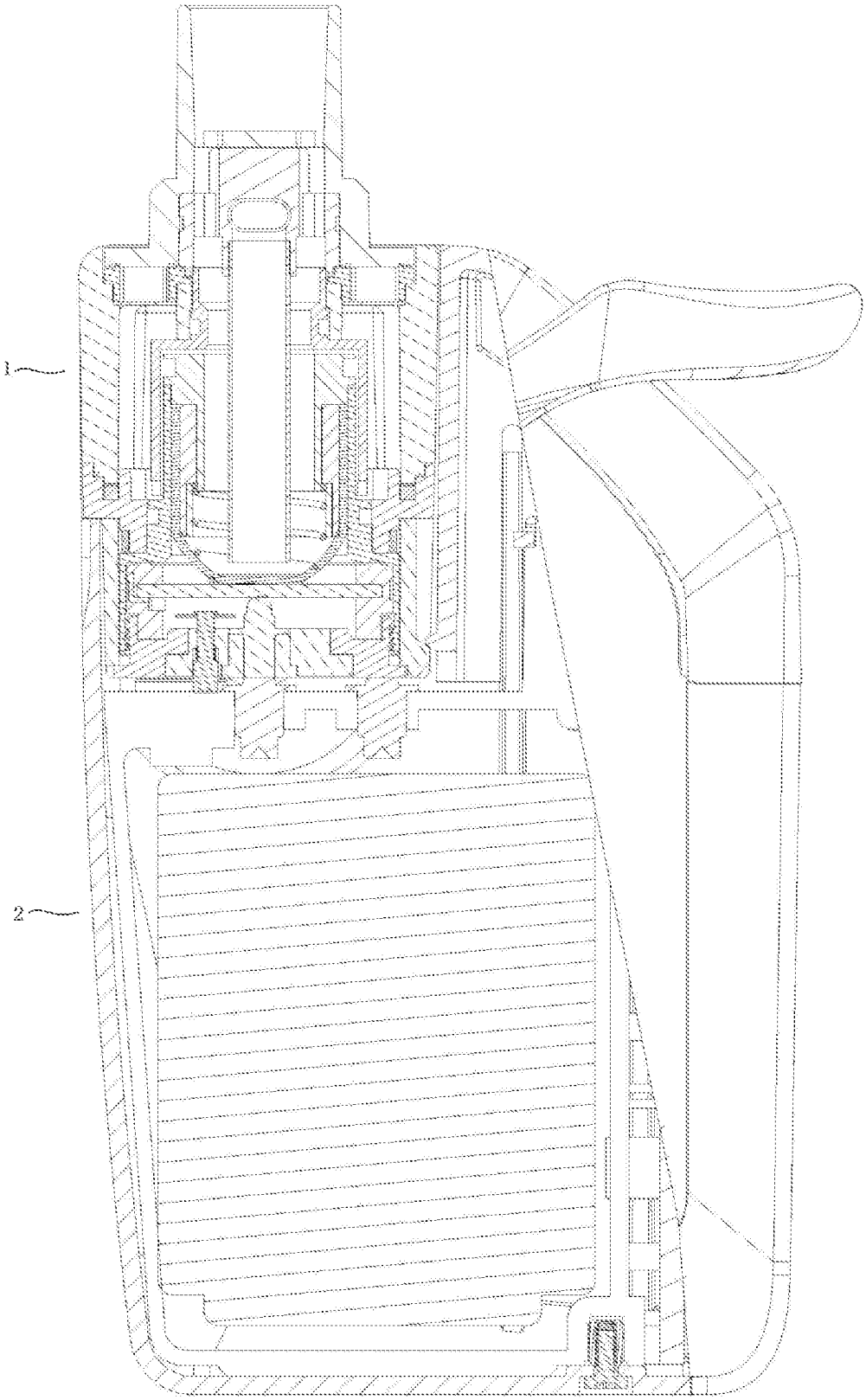
FIG. 4 is a schematic structural diagram of Embodiment 2 of an ultrasonic electronic cigarette.
Figure 5:
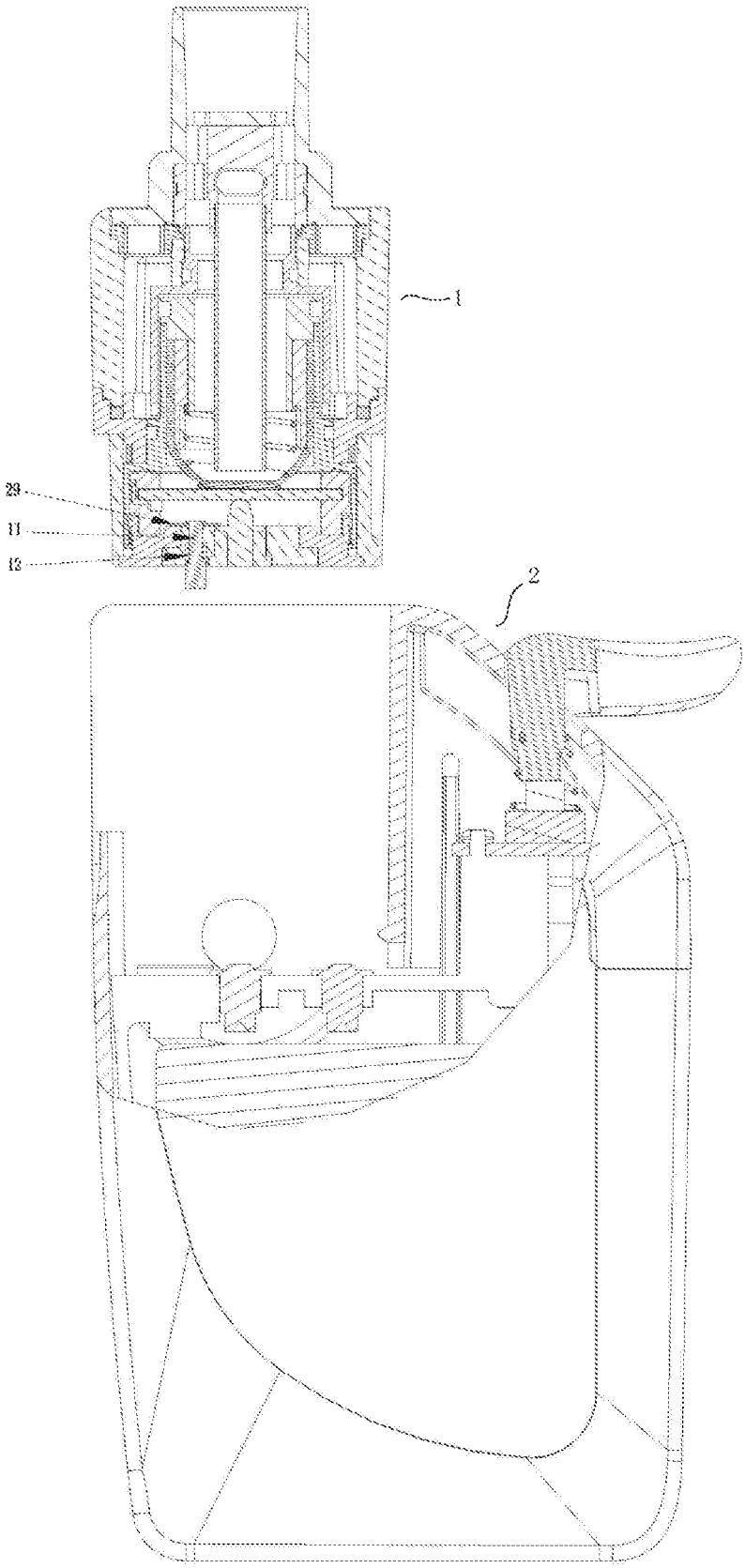
FIG. 5 is a schematic structural diagram when an atomizer and a battery assembly in FIG. 4 are separated.

FIG. 4 and FIG. 5 show a structure of a second embodiment of an ultrasonic electronic cigarette. The structure of the second embodiment of the ultrasonic electronic cigarette is similar to that of the first embodiment, except that the conductive sheet 29 is fixedly connected to the top of the ejection shaft 11 and can move up and down with the ejection shaft 11; when the atomizer 1 is connected to the battery assembly 2, the first spring 12 is compressed, the ejection shaft 11 drives the conductive sheet 29 to move up, and the threaded seat 9 and the lower electrode 8 are both disconnected from the conductive sheet 29; and when the atomizer 1 is disconnected from the battery assembly 2, the ejection shaft 11 moves down under the restoring force of the first spring 12, and the conductive sheet 29 is reset and abuts against the lower electrode 8 and the threaded seat 9. The same structure in the second embodiment as in the first embodiment is not described herein, which does not affect the understanding and implementation of the present invention by those skilled in the art.

The embodiments of the present invention are described above with reference to the drawings, but the present invention is not limited to the specific embodiments. The specific embodiments described above are merely illustrative but not restrictive. Many forms may also be made by those of ordinary skill in the art under the enlightenment of the present invention without departing from the purpose of the present invention and the scope of the claims, and these forms fall into the scope of the present invention.

The invention claimed is:

1. An ultrasonic electronic cigarette, comprising an atomizer (1) and a battery assembly (2) detachably connected to each other, wherein:

the atomizer (1) comprises an ultrasonic atomization sheet (3), and the battery assembly (2) comprises a first battery electrode (4) and a second battery electrode (5) for supplying power to the atomizer (1);

when the atomizer (1) is connected to the battery assembly (2), a first pole of the ultrasonic atomization sheet (3) is electrically connected to the first battery electrode (4), and a second pole of the ultrasonic atomization sheet (3) is electrically connected to the second battery electrode (5);

the atomizer (1) also comprises a conductive sheet (29) capable of:

being electrically connected to the two poles of the ultrasonic atomization sheet (3) respectively when the atomizer (1) is disconnected from the battery assembly (2), and being electrically disconnected from either pole of the ultrasonic atomization sheet (3) when the atomizer (1) is connected to the battery assembly (2).

2. The ultrasonic electronic cigarette according to claim 1, wherein:

the atomizer (1) comprises an elastic connecting mechanism (6), and the battery assembly (2) comprises a support (7) corresponding to the elastic connecting mechanism (6);

when the atomizer (1) is connected to the battery assembly (2), one end of the elastic connecting mechanism abuts against the support (7), and the other end of the elastic connecting mechanism (6) abuts against the conductive sheet (29) such that the conductive sheet (29) is electrically disconnected from either pole of the ultrasonic atomization sheet (3); and when the atomizer (1) is disconnected from the battery assembly (2), the elastic connecting mechanism (6) is reset and the conductive sheet (29) is electrically connected to the two poles of the ultrasonic atomization sheet (3) respectively.

3. The ultrasonic electronic cigarette according to claim 2, wherein:

the atomizer (1) comprises a lower electrode (8) and a threaded seat (9), the first pole of the ultrasonic atomization sheet (3) is electrically connected to the lower electrode (8), and the second pole of the ultrasonic atomization sheet (3) is electrically connected to the threaded seat (9);

when the atomizer (1) is connected to the battery assembly (2), one end of the elastic connecting mechanism (6) abuts against the conductive sheet (29) such that the conductive sheet (29) is electrically disconnected from the threaded seat (9); and when the atomizer (1) is disconnected from the battery assembly (2), the elastic connecting mechanism (6) is reset and both the lower electrode (8) and the threaded seat (9) are electrically connected to the conductive sheet (29).

4. The ultrasonic electronic cigarette according to claim 3, wherein:

the lower electrode (8) is insulated from and connected to the threaded seat (9) through an insulating ring (10);

the elastic connecting mechanism (6) comprises an ejection shaft (11) and a first spring (12), the insulating ring (10) is provided with a through hole (101), the ejection shaft (11) is disposed in the through hole (101) and can move along the through hole (101), the ejection shaft (11) is higher than the through hole (101), the first spring (12) is sleeved on a middle section of the ejection shaft (11), one end of the first spring (12) abuts against an outer side wall of the ejection shaft (11), and the other end of the first spring (12) abuts against an inner side wall of the through hole (101);

when the atomizer (1) is connected to the battery assembly (2), the first spring (12) is compressed, a bottom end of the ejection shaft (11) abuts against the support (7), and a top end of the ejection shaft (11) abuts against the conductive sheet (29) such that the conductive sheet (29) is disconnected from the threaded seat (9); and when the atomizer (1) is disconnected from the battery assembly (2), the ejection shaft (11) moves down under the restoring force of the first spring (12), and the conductive sheet (29) is reset and abuts against the threaded seat (9).

5. The ultrasonic electronic cigarette according to claim 4, wherein:

one end of the conductive sheet (29) is fixedly connected to the lower electrode (8), the bottom surface of a middle section of the conductive sheet (29) abuts against the top end of the ejection shaft (11), and the bottom surface of the other end of the conductive sheet (29) moves up and down with the ejection shaft (11) to be connected with or disconnected from the threaded seat (9).

6. The ultrasonic electronic cigarette according to claim 4, wherein:

the conductive sheet (29) is fixedly connected to the top of the ejection shaft (11) and can move up and down with the ejection shaft (11);

when the atomizer (1) is connected to the battery assembly (2), the first spring (12) is compressed, the ejection shaft (11) drives the conductive sheet (29) to move up, and the threaded seat (9) and the lower electrode (8) are both disconnected from the conductive sheet (29); and when the atomizer (1) is disconnected from the battery assembly (2), the ejection shaft (11) moves down under the restoring force of the first spring (12), and the conductive sheet (29) is reset and abuts against the lower electrode (8) and the threaded seat (9).

7. The ultrasonic electronic cigarette according to claim 5, wherein the insulating ring (10) is also provided with a limiting boss (102) for preventing the ejection shaft (11) from falling off from the through hole (101).

8. The ultrasonic electronic cigarette according to claim 5, wherein one end of the conductive sheet (29) is fixedly connected to the lower electrode (8) by riveting.

9. The ultrasonic electronic cigarette according to claim 1, wherein the atomizer (1) comprises a liquid chamber (13) and a liquid guiding mechanism for connecting the liquid chamber (13) and the ultrasonic atomization sheet (3).

10. The ultrasonic electronic cigarette according to claim 2, wherein the atomizer (1) comprises a liquid chamber (13) and a liquid guiding mechanism for connecting the liquid chamber (13) and the ultrasonic atomization sheet (3).

11. The ultrasonic electronic cigarette according to claim 3, wherein the atomizer (1) comprises a liquid chamber (13) and a liquid guiding mechanism for connecting the liquid chamber (13) and the ultrasonic atomization sheet (3).

12. The ultrasonic electronic cigarette according to claim 4, wherein the atomizer (1) comprises a liquid chamber (13) and a liquid guiding mechanism for connecting the liquid chamber (13) and the ultrasonic atomization sheet (3).

13. The ultrasonic electronic cigarette according to claim 5, wherein the atomizer (1) comprises a liquid chamber (13) and a liquid guiding mechanism for connecting the liquid chamber (13) and the ultrasonic atomization sheet (3).

14. The ultrasonic electronic cigarette according to claim 6, wherein the atomizer (1) comprises a liquid chamber (13) and a liquid guiding mechanism for connecting the liquid chamber (13) and the ultrasonic atomization sheet (3).

15. The ultrasonic electronic cigarette according to claim 7, wherein the atomizer (1) comprises a liquid chamber (13) and a liquid guiding mechanism for connecting the liquid chamber (13) and the ultrasonic atomization sheet (3).

16. The ultrasonic electronic cigarette according to claim 8, wherein the atomizer (1) comprises a liquid chamber (13) and a liquid guiding mechanism for connecting the liquid chamber (13) and the ultrasonic atomization sheet (3).

17. The ultrasonic electronic cigarette according to claim 9, wherein:

the atomizer (1) comprises a cup-shaped atomization cotton (14), a liquid storage cotton tube (15), an inner sleeve (16), and an outer sleeve (17) sleeved on the inner sleeve (16), a side wall of the atomization cotton (14) is sleeved between the inner sleeve (16) and the outer sleeve (17), an outer bottom surface of the atomization cotton (14) abuts against the atomization cotton (14) of the ultrasonic atomization sheet (3), the liquid storage cotton tube (15) is sleeved between the atomization cotton (14) and the inner sleeve (16), and the outer sleeve (17) is provided with a liquid inlet hole (1701) for connecting the liquid chamber (13) with the atomization cotton (14).

18. The ultrasonic electronic cigarette according to claim 10, wherein:

the atomizer (1) comprises a cup-shaped atomization cotton (14), a liquid storage cotton tube (15), an inner sleeve (16), and an outer sleeve (17) sleeved on the inner sleeve (16), a side wall of the atomization cotton (14) is sleeved between the inner sleeve (16) and the outer sleeve (17), an outer bottom surface of the atomization cotton (14) abuts against the atomization cotton (14) of the ultrasonic atomization sheet (3), the liquid storage cotton tube (15) is sleeved between the atomization cotton (14) and the inner sleeve (16), and the outer sleeve (17) is provided with a liquid inlet hole (1701) for connecting the liquid chamber (13) with the atomization cotton (14).

19. The ultrasonic electronic cigarette according to claim 11, wherein:

the atomizer (1) comprises a cup-shaped atomization cotton (14), a liquid storage cotton tube (15), an inner sleeve (16), and an outer sleeve (17) sleeved on the inner sleeve (16), a side wall of the atomization cotton (14) is sleeved between the inner sleeve (16) and the outer sleeve (17), an outer bottom surface of the atomization cotton (14) abuts against the atomization cotton (14) of the ultrasonic atomization sheet (3), the liquid storage cotton tube (15) is sleeved between the atomization cotton (14) and the inner sleeve (16), and the outer sleeve (17) is provided with a liquid inlet hole (1701) for connecting the liquid chamber (13) with the atomization cotton (14).

20. The ultrasonic electronic cigarette according to claim 12, wherein:

the atomizer (1) comprises a cup-shaped atomization cotton (14), a liquid storage cotton tube (15), an inner sleeve (16), and an outer sleeve (17) sleeved on the inner sleeve (16), a side wall of the atomization cotton (14) is sleeved between the inner sleeve (16) and the outer sleeve (17), an outer bottom surface of the atomization cotton (14) abuts against the atomization cotton (14) of the ultrasonic atomization sheet (3), the liquid storage cotton tube (15) is sleeved between the atomization cotton (14) and the inner sleeve (16), and the outer sleeve (17) is provided with a liquid inlet hole (1701) for connecting the liquid chamber (13) with the atomization cotton (14).

* * * * *